US011124867B1

(12) United States Patent
Kuo et al.

(10) Patent No.: US 11,124,867 B1
(45) Date of Patent: Sep. 21, 2021

(54) GRADIENT MATERIAL LAYER AND METHOD FOR MANUFACTURING THE SAME

(71) Applicant: National Taiwan University of Science and Technology, Taipei (TW)

(72) Inventors: Yu-Lin Kuo, Taipei (TW); Hsien-Po Wang, Taipei (TW); Jhao-Yu Guo, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 0 days.

(21) Appl. No.: 16/817,613

(22) Filed: Mar. 13, 2020

(51) Int. Cl.

| | |
|---|---|
| ***C23C 8/36*** | (2006.01) |
| ***C23C 8/24*** | (2006.01) |
| ***C23C 8/02*** | (2006.01) |

(52) U.S. Cl.
CPC ..... *C23C 8/36* (2013.01); *C23C 8/02* (2013.01); *C23C 8/24* (2013.01)

(58) Field of Classification Search
CPC ..... C23C 8/36; C23C 8/24
See application file for complete search history.

(56) References Cited

U.S. PATENT DOCUMENTS

| | | | | |
|---|---|---|---|---|
| 5,685,949 | A * | 11/1997 | Yashima | H01J 37/32082 134/1.1 |
| 6,180,189 | B1 | 1/2001 | Steinwandel et al. | |
| 2008/0129208 | A1 | 6/2008 | Kumar et al. | |

FOREIGN PATENT DOCUMENTS

| | | |
|---|---|---|
| CN | 104114649 | 10/2014 |
| JP | 2013023769 | 2/2013 |
| JP | 2014111821 | 6/2014 |
| TW | 201618210 | 5/2016 |
| WO | 2018172816 | 9/2018 |

OTHER PUBLICATIONS

Jie-Long Wang et al., "Self-Growing Functional Layers on SKD11 Die Steels by Atmospheric Pressure Plasma," TACT2019 International Thin Films Conference, Nov. 17-20, 2019, pp. 1-15.
R. Ichiki et al., "Nitriding of steel surface by spraying pulsed-arc plasma jet under atmospheric pressure," Materials Letters, vol. 71, Mar. 15, 2012, pp. 134-136.
H. Nagamatsu et al., "Steel nitriding by atmospheric-pressure plasma jet using N2/H2 mixture gas," Surface and Coatings Technology, vol. 225, Jun. 25, 2013, pp. 26-33.
R. Ichiki et al., "Peculiar Relationship of Plume Brightness and Hard Layer Formation in Atmospheric-Pressure Plasma Jet Nitriding," IEEE Transactions on Plasma Science, vol. 42, Issue 10, Oct. 2014, pp. 2466-2467.
Wen-Feng Lu, "Rapid nitriding of AISI 316 by high density plasma jet at atmospheric ambient condition," Thesis of Master Degree, NTHU, Jul. 2007, pp. 1-93.

* cited by examiner

*Primary Examiner* — Jessee R Roe
(74) *Attorney, Agent, or Firm* — JCIPRNET

(57) ABSTRACT

The present invention provides a gradient material layer and a method for manufacturing the same. The gradient material layer has a base-material region, a diffusion region, and a compound region, wherein the diffusion region is located between the base-material region and the compound region. The base-material region includes a metal material. The diffusion region doped with nitrogen includes the metal material. The compound region includes metal nitride. The nitrogen content of the compound region is greater than that of the diffusion region.

5 Claims, 4 Drawing Sheets

GRADIENT MATERIAL LAYER AND METHOD FOR MANUFACTURING THE SAME

TECHNICAL FIELD

The invention relates to a gradient material layer and a method for manufacturing the same, and in particular, to a gradient material layer subjected to nitriding with atmospheric pressure plasma and a method for manufacturing the same.

RELATED ART

In the technical field of surface treatment, nitriding is not only characterized by high precision, but also enables a treated material to have excellent mechanical properties (for example, high strength or high wear resistance, etc.). Generally, nitriding may be classified into gas nitriding, ion nitriding and soft nitriding. However, the above-mentioned nitriding processes each have some disadvantages, for example, excessively long process time (about 40 to 100 hours), necessary use of toxic gases (for example, ammonia gas or cyanides, etc.) in the process, limited product size and so on. Therefore, how to develop a nitriding process having characteristics such as environmental friendliness, short process time, and relatively few limitations on product size, has become one of the active research topics for research developers.

SUMMARY OF THE INVENTION

The invention provides a gradient material layer characterized by having a tunable nitrogen content gradient distribution, and further, tunable mechanical properties and good stability.

The invention provides a gradient material layer having characteristics such as short process time and relatively few limitations on product size and so on.

The invention provides a gradient material layer having a base-material region, a diffusion region and a compound region, wherein the diffusion region is located between the base-material region and the compound region. The base-material region includes a metal material. The diffusion region is doped with nitrogen and includes the metal material. The compound region includes a metal nitride. The compound region has a greater nitrogen content than the diffusion region.

According to an embodiment of the invention, in the gradient material layer, the nitrogen content of the gradient material layer gradually increases in a direction from the base-material region to the compound region.

According to an embodiment of the invention, in the gradient material layer, hardness of the gradient material layer gradually increases in the direction from the base-material region to the compound region.

According to an embodiment of the invention, in the gradient material layer, the metal nitride and the metal material have the same metal element.

According to an embodiment of the invention, in the gradient material layer, the diffusion region does not contain the metal nitride.

The invention provides a method for manufacturing a gradient material layer, including the following steps: providing a metal material layer; performing nitriding on the metal material layer with atmospheric pressure plasma to form the gradient material layer, wherein the gradient material layer has a base-material region, a diffusion region and a compound region, and the diffusion region is located between the base-material region and the compound region, wherein the compound region has a greater nitrogen content than the diffusion region.

According to an embodiment of the invention, in the method for manufacturing a gradient material layer, a gas used in the nitriding includes a mixed gas composed of nitrogen gas and hydrogen gas.

According to an embodiment of the invention, in the method for manufacturing a gradient material layer, a content of the hydrogen gas in the mixed gas is between 0% and 5%.

According to an embodiment of the invention, in the method for manufacturing a gradient material layer, duration of the nitriding is between 1 second and 10000 seconds.

According to an embodiment of the invention, in the method for manufacturing a gradient material layer, a surface treatment is performed on the metal material layer before the nitriding.

Based on the above, in the gradient material layer and the method for manufacturing the same as proposed in the invention, by performing nitriding on the metal material layer with atmospheric pressure plasma, the thus formed gradient material layer has the base-material region, the compound region, and the diffusion region located between the above two, wherein the compound region has a greater nitrogen content than the diffusion region. In this way, the gradient material layer is characterized by having a tunable nitrogen content gradient distribution, and further, tunable mechanical properties (for example, tunable hardness) and good stability.

In another aspect, since the atmospheric pressure plasma is not limited by the size of vacuum chamber and can be continuously produced, the nitriding exhibits characteristics such as short process time and relatively few limitations on product size and so on.

To make the above features and advantages of the invention more comprehensible, examples accompanied with drawings are described in detail as follows.

DESCRIPTION OF THE EMBODIMENTS

Figure 1:
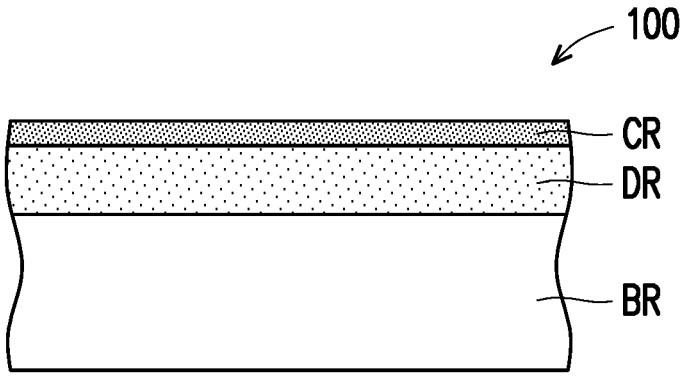
FIG. 1 is a schematic cross-sectional view of a gradient material layer according to an embodiment of the invention.

The invention is described more comprehensively with reference to the drawings of the present embodiment. However, the invention may be embodied in many different forms and should not be construed as limited to the embodiments set forth herein. Thicknesses of layers and regions in the drawings may be enlarged for clarity. The same or similar reference numerals represent the same or similar components, and are not repeated in the following paragraphs. Directional terms mentioned in the embodiments, for example, up, down, left, right, front, or back, etc., only refer to directions in the accompanying drawings. Therefore, the directional terms are used to illustrate rather than limit the invention.

FIG. 1 is a schematic cross-sectional view of a gradient material layer according to an embodiment of the invention.

Referring to FIG. 1 at the same time, a gradient material layer 100 has a base-material region BR, a diffusion region DR and a compound region CR, wherein the diffusion region DR is located between the base-material region BR and the compound region CR. In some embodiments, the compound region CR may be located adjacent to a surface of the gradient material layer 100. That is, in a direction from the surface to the inside of the gradient material layer 100, the compound region CR, the diffusion region DR and the base-material region BR may be provided in this order. In the present embodiment, the compound region CR may have a smaller thickness than the diffusion region DR. However, the invention is not limited thereto. In other embodiments, the thicknesses of the compound region CR and the diffusion region DR may be adjusted according to the design. The gradient material layer 100 may include a metal material, for example, iron (Fe), chromium (Cr), vanadium (V), manganese (Mn), molybdenum (Mo), or an alloy thereof, or a combination of the foregoing materials. In some embodiments, the gradient material layer 100 may further include carbon (C), silicon (Si), or a combination thereof.

In the present embodiment, the base-material region BR includes a metal material (for example, iron, chromium, or a combination thereof); the diffusion region DR is doped with nitrogen and includes the above-mentioned metal material (for example, iron or chromium doped with a nitrogen element); the compound region CR includes a metal nitride (for example, iron nitride or chromium nitride), and the compound region CR has a greater nitrogen content than the diffusion region DR (as shown in FIG. 2A and FIG. 2B). In this way, the gradient material layer 100 is characterized by having a tunable nitrogen content gradient distribution, and further, tunable mechanical properties (for example, tunable hardness) and good stability.

In the present embodiment, the compound region CR may have a greater nitrogen content than the diffusion region DR, and the diffusion region DR may have a greater nitrogen content than the base-material region BR. For example, the nitrogen content of the gradient material layer 100 gradually increases in a direction from the base-material region BR to the compound region CR, that is, the nitrogen content of the gradient material layer 100 exhibits a gradually increasing gradient from its core (or inside) to its surface. In this way, hardness of the gradient material layer 100 gradually increases in the direction from the base-material region BR to the compound region CR.

In the present embodiment, the metal nitride in the compound region CR and the metal material in the base-material region BR may have the same metal element. For example, the metal nitride in the compound region CR may be iron nitride (for example, $Fe_4N$, $Fe_3N$, or $Fe_2N$, etc.), chromium nitride, or a combination thereof; and the metal material in the base-material region BR may be iron, chromium, or a combination thereof. In the present embodiment, the diffusion region BR may not contain the metal nitride in the compound region CR. For example, the diffusion region BR may be in a state in which iron or chromium is doped with nitrogen, but neither iron nitride nor chromium nitride is formed.

Figure 2:
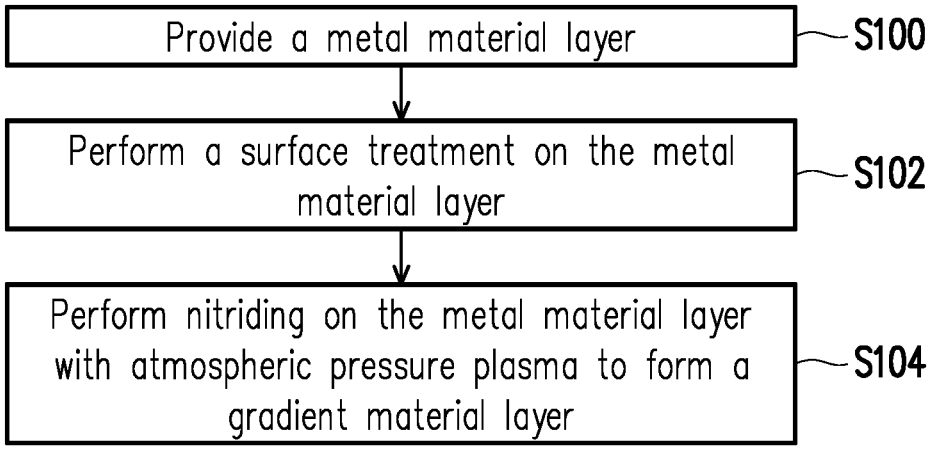
FIG. 2 is a flowchart of a method for manufacturing a gradient material layer according to an embodiment of the invention.

FIG. 2 is a flowchart of a method for manufacturing a gradient material layer according to an embodiment of the invention. A method for forming the gradient material layer 100 will be described below with reference to FIG. 2. However, the invention is not limited thereto.

Referring to FIG. 2, first, step S100 is performed in which a metal material layer is provided. In some embodiments, in order to increase the strength and elasticity of metallic materials, the metal material layer may selectively include a silicon element. In some other embodiments, in order to increase the hardness, yield strength or tensile strength of metallic materials, the metal material layer may selectively include a carbon element.

Next, step S104 is performed in which nitriding is performed on the metal material layer with atmospheric pressure plasma to form the gradient material layer 100 having the base-material region BR, the diffusion region DR and the compound region CR. In this way, the gradient material layer 100 is characterized by having a tunable nitrogen content gradient distribution, and further, tunable mechanical properties (for example, tunable hardness) and good stability. In another aspect, since the atmospheric pressure plasma is not limited by the size of vacuum chamber and can be continuously produced, the nitriding exhibits characteristics such as short process time and relatively few limitations on product size and so on. In the present embodiment, the diffusion region DR may be located between the base-material region BR and the compound region CR.

In the present embodiment, atmospheric pressure plasma (APP) may be used to perform nitriding on the metal material layer. In the present embodiment, in the above-mentioned process of performing nitriding with atmospheric pressure plasma, a gas used may include a mixed gas composed of nitrogen gas and hydrogen gas, and there is no need to use toxic gases such as ammonia gas or the like. Thus, the above-mentioned nitriding process is environmentally friendly. In addition, since local nitriding may be selectively performed on the metal material layer with atmospheric pressure plasma, the process is widely applicable.

In the present embodiment, in the mixed gas composed of nitrogen gas and hydrogen gas, as the proportion of the introduced hydrogen gas gradually increases, the hardness of the gradient material layer increases. However, if the content of hydrogen gas in the mixed gas is too large, the nitriding effect is reduced. In the present embodiment, the content of hydrogen gas in the mixed gas may be greater than 0% and less than 5% to achieve a good nitriding effect. In another aspect, compared with a mixed gas containing no hydrogen gas, the mixed gas containing hydrogen gas exhibits a more significant nitriding effect. In the present embodiment, a ratio of nitrogen gas to hydrogen gas in the mixed gas can be controlled by adjusting their flow ratio ($N_2/H_2$). However, the invention is not limited thereto.

In the present embodiment, in the above-mentioned process of performing nitriding with atmospheric pressure plasma, the duration of the nitriding may be between 1 second and 10,000 seconds. Compared with the process time (40 to 100 hours) of conventional nitriding, the nitriding of the present embodiment can achieve a good nitriding effect in a short time.

In some embodiments, before the nitriding is performed (that is, step S104), a surface treatment may be selectively performed on the metal material layer (that is, step S102). In this way, oxides or dirt on a surface of the metal material layer can be removed so that diffusion of nitrogen atoms into the metal material layer will not be hindered, and thus, the growth of the gradient material layer will not be inhibited. In some embodiments, before the nitriding is performed, a surface treatment process such as grinding, polishing or the like may be performed on the surface of the metal material layer.

Based on the above, by performing nitriding on the metal material layer with atmospheric pressure plasma, the thus formed gradient material layer has the base-material region, the compound region, and the diffusion region located between the above two, wherein the compound region has a greater nitrogen content than the diffusion region. In this way, the gradient material layer is characterized by having a tunable nitrogen content gradient distribution, and further, tunable mechanical properties (for example, tunable hardness) and good stability. In another aspect, since the atmospheric pressure plasma is not limited by the size of vacuum chamber and can be continuously produced, the nitriding exhibits characteristics such as short process time and relatively few limitations on product size and so on.

Hereinafter, the features of the invention will be more specifically described with reference to Example 1 and a reference example. Although the following example is described, the materials used, the amounts and ratios thereof, the processing details, the processing procedures and so on can be suitably modified without departing from the scope of the invention. Accordingly, restrictive interpretation should not be made to the invention based on the example described below.

Example 1

Nitriding was performed on a metal material with atmospheric pressure plasma to form a gradient material layer, which included the following steps: (1) the metal material was provided on a platform; (2) nitrogen gas and hydrogen gas were introduced and the flow rate of both gases was adjusted. (3) The atmospheric pressure plasma was turned on, and the platform carrying the metal material was moved to under the atmospheric pressure plasma to perform the nitriding. The parameter information of the above-mentioned preparation of the gradient material layer of Example 1 by using atmospheric pressure plasma is as shown below.

Metal Material: Steel

Gas used in the atmospheric pressure plasma: $N_2$+$H_2$

Proportion of hydrogen gas in the mixed gas: 2%

Reference Example

The same metal material as in Example 1 was used. However, no nitriding was performed.

The following tests were respectively conducted on Example 1 or the reference example:

[Cross-Section Hardness Test]

Figure 3:
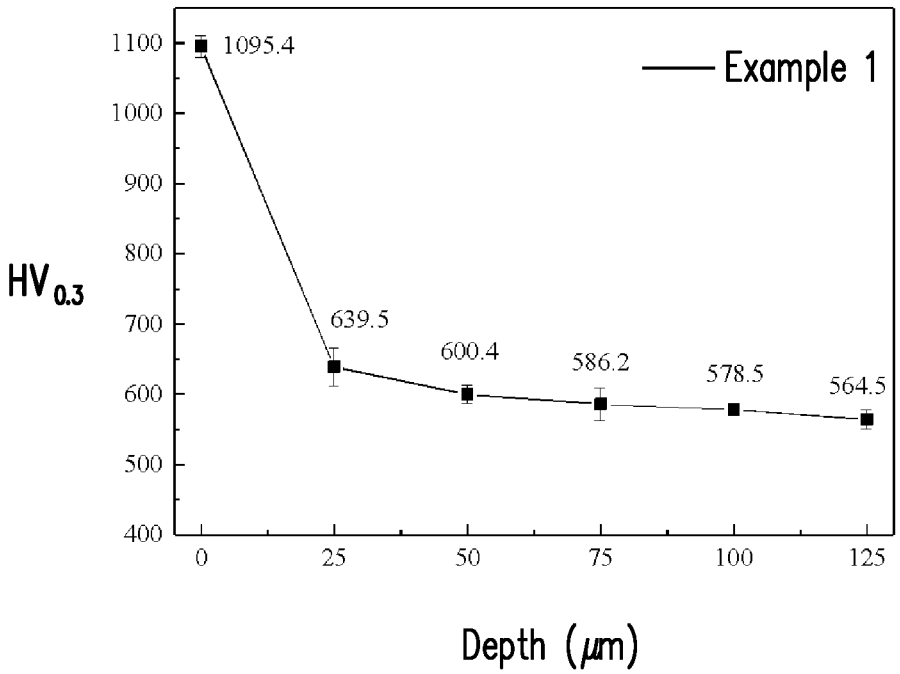
FIG. 3 illustrates a relationship between Vickers hardness and depth of Example 1.

FIG. 3 illustrates a relationship between Vickers hardness and depth of Example 1. Cross-section hardness of Example 1 was analyzed using a Vickers hardness tester. The load used in the Vickers hardness test was 300 gf (indicated as $HV_{0.3}$), and the test results are shown in FIG. 3.

As can be seen from FIG. 3, the hardness of the gradient material layer of Example 1 from the surface to the core (or inside) gradually decreases in a gradient manner. This shows that the nitrogen content gradually decreased from the surface to the inside of the gradient material layer, reflecting that nitrogen atoms diffused from the surface to the inside of the steel.

[X-Ray Diffraction Analysis]

Figure 4A:
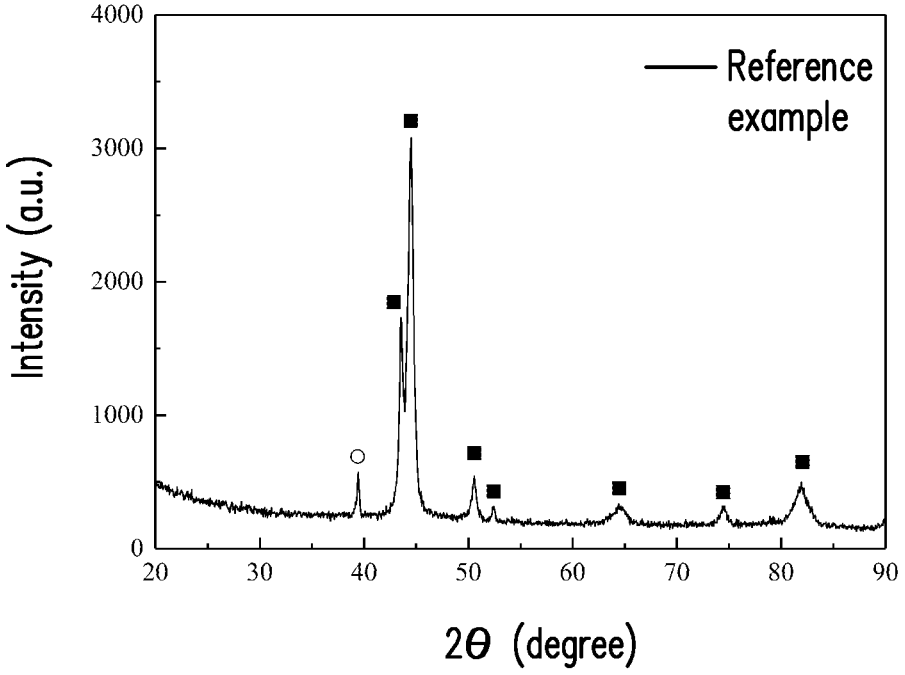
FIG. 4A and FIG. 4B illustrate X-ray diffraction (XRD) curves of Example 1 and a reference example, respectively.
Figure 4B:
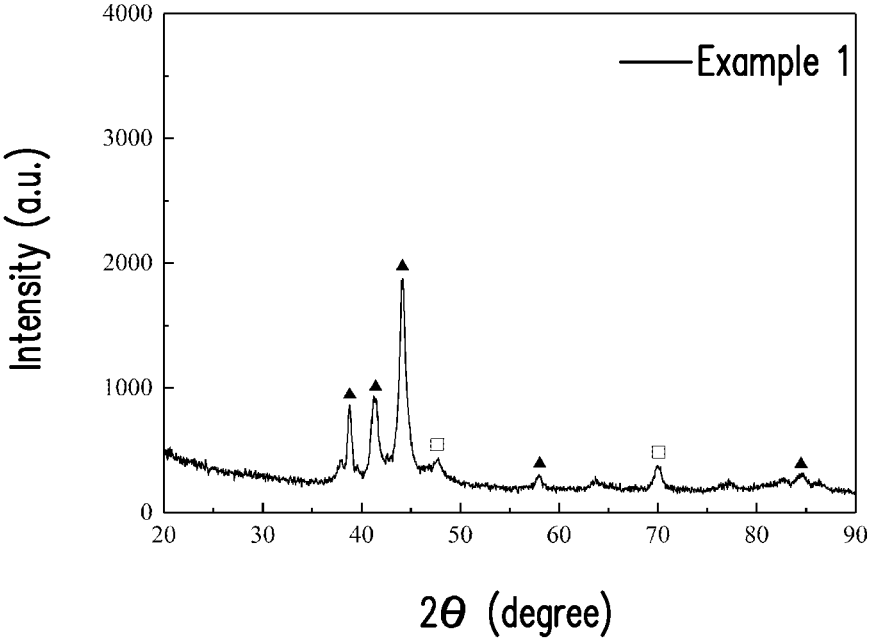

FIG. 4A and FIG. 4B illustrate X-ray diffraction (XRD) curves of Example 1 and the reference example, respectively. X-ray diffraction (XRD) analysis was performed on Example 1 and the reference example, respectively, and the test results are shown in FIG. 4A and FIG. 4B. In FIG. 4A and FIG. 4B, ○ represents a diffraction peak signal of $Fe_2O_3$; ■ represents a diffraction peak signal of Fe; ▲ represents a diffraction peak signal of $Fe_{2-3}N$; and □ represents a diffraction peak signal of $Fe_4N$.

As can be seen from FIG. 4A and FIG. 4B, the gradient material layer of Example 1 had a significant nitriding effect.

[Analysis by Electron Probe Microanalyzer]

Figure 5:
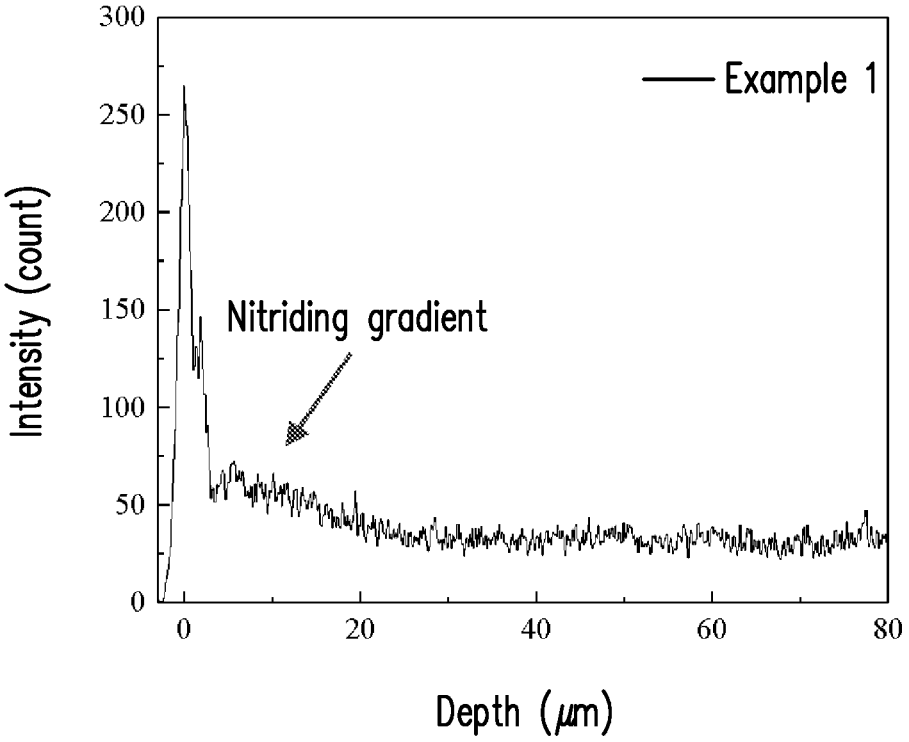
FIG. 5 illustrates a relationship between nitrogen content and depth of Example 1.

FIG. 5 illustrates a relationship between nitrogen content and depth of Example 1. Example 1 was subjected to an electron probe microanalyzer (EMPA), and the test results are shown in FIG. 5. As can be seen from FIG. 5, in the gradient material layer of Example 1, a signal of the nitrogen element on the surface was much higher than a signal of the nitrogen element inside, and a clear nitriding gradient was shown.

In summary, in the gradient material layer and the method for manufacturing the same as proposed in the above embodiment, by performing nitriding on the metal material layer with atmospheric pressure plasma, the thus formed gradient material layer has the base-material region, the compound region, and the diffusion region located between the above two, wherein the compound region has a greater nitrogen content than the diffusion region. In this way, the gradient material layer is characterized by having a tunable nitrogen content gradient distribution, and further, tunable mechanical properties (for example, tunable hardness) and good stability. In another aspect, since the atmospheric pressure plasma is not limited by the size of vacuum chamber and can be continuously produced, the nitriding exhibits characteristics such as short process time and relatively few limitations on product size and so on.

Although the invention has been described with reference to the above examples, it will be apparent to one of ordinary skill in the art that modifications to the described examples may be made without departing from the spirit of the invention. Accordingly, the scope of the invention will be defined by the attached claims and not by the above detailed descriptions.

What is claimed is:

1. A method for manufacturing a gradient material layer, comprising:

providing a metal material layer; and performing nitriding on the metal material layer with atmospheric pressure plasma to form the gradient material layer, wherein the gradient material layer has a base-material region, a diffusion region and a compound region, and the diffusion region is located between the base-material region and the compound region, wherein the compound region has a greater nitrogen content than the diffusion region.

2. The method for manufacturing a gradient material layer according to claim 1, wherein a gas used in the nitriding comprises a mixed gas composed of nitrogen gas and hydrogen gas.

3. The method for manufacturing a gradient material layer according to claim 2, wherein a content of the hydrogen gas in the mixed gas is between 0% and 5%.

4. The method for manufacturing a gradient material layer according to claim 1, wherein duration of the nitriding is between 1 second and 10000 seconds.

5. The method for manufacturing a gradient material layer according to claim 1, wherein a surface treatment is performed on the metal material layer before the nitriding.

* * * * *